US007694526B2

(12) United States Patent
Inoue et al.

(10) Patent No.: US 7,694,526 B2
(45) Date of Patent: Apr. 13, 2010

(54) SHIELDING MEMBER AND INDOOR UNIT OF AN AIR CONDITIONER

(75) Inventors: Kiyoshi Inoue, Kusatsu (JP); Katsuhiro Wakihara, Kusatsu (JP); Naoko Asai, Moriyama (JP); Toshiaki Yamada, Kusatsu (JP); Ikuhiro Yamada, Kashihara (JP); Shiro Kashiwa, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 183 days.

(21) Appl. No.: 11/666,681

(22) PCT Filed: Oct. 31, 2005

(86) PCT No.: PCT/JP2005/019994

§ 371 (c)(1),
(2), (4) Date: May 1, 2007

(87) PCT Pub. No.: WO2006/049122

PCT Pub. Date: May 11, 2006

(65) Prior Publication Data

US 2007/0245757 A1 Oct. 25, 2007

(30) Foreign Application Priority Data

Nov. 2, 2004 (JP) ..... 2004-319553

(51) Int. Cl.
*F25D 17/06* (2006.01)

(52) U.S. Cl. ..... 62/426; 62/259.1

(58) Field of Classification Search ..... 62/259.1, 62/305, 426, 428
See application file for complete search history.

(56) References Cited

U.S. PATENT DOCUMENTS 7,363,770 B2 * 4/2008 Hong et al. ..... 62/271

FOREIGN PATENT DOCUMENTS

| | | | |
|---|---|---|---|
| JP | 05-42924 | U | 6/1993 |
| JP | 07-42010 | U | 9/1995 |
| JP | 10-019340 | A | 1/1998 |
| JP | 11-264564 | A | 9/1999 |
| SU | 966428 | | 10/1982 |

* cited by examiner

*Primary Examiner*—Melvin Jones
(74) *Attorney, Agent, or Firm*—Global IP Counselors

(57) ABSTRACT

A shielding member includes a shielding plate for covering a part of a heat exchanger, heat transfer tube engagement sections for engaging with heat transfer tubes of the heat exchanger, fin engagement portions for engaging with fins of the heat exchanger, a bypass preventing rib for preventing air from being directed to the part of the heat exchanger, and a mismounting preventing portion for preventing the shielding member from being mounted on a heat exchanger that does not require blocking of air flow. The heat exchanger in which the part covered with the shielding member has no heat exchanging function is manufactured with the same components as those of a heat exchanger on which the shielding member is not mounted and the whole of which has a heat exchanging function.

12 Claims, 11 Drawing Sheets

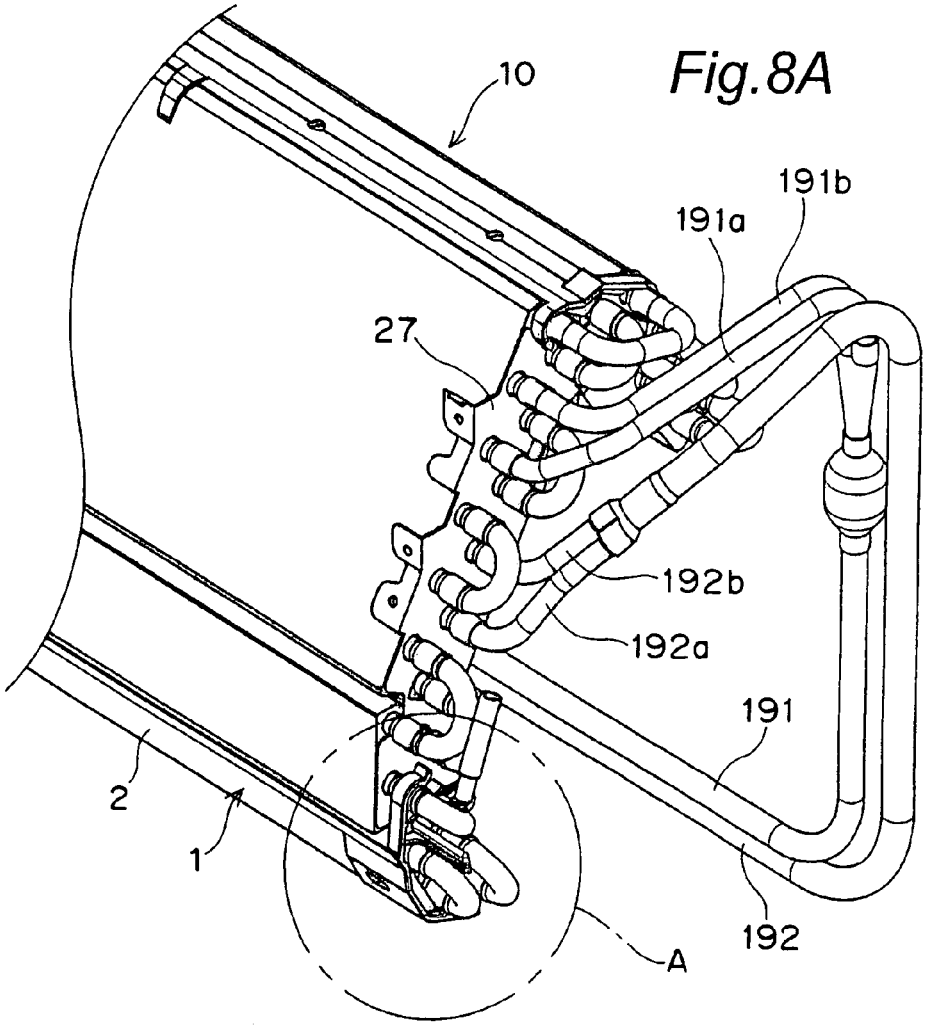
Fig.8A
Fig.8B
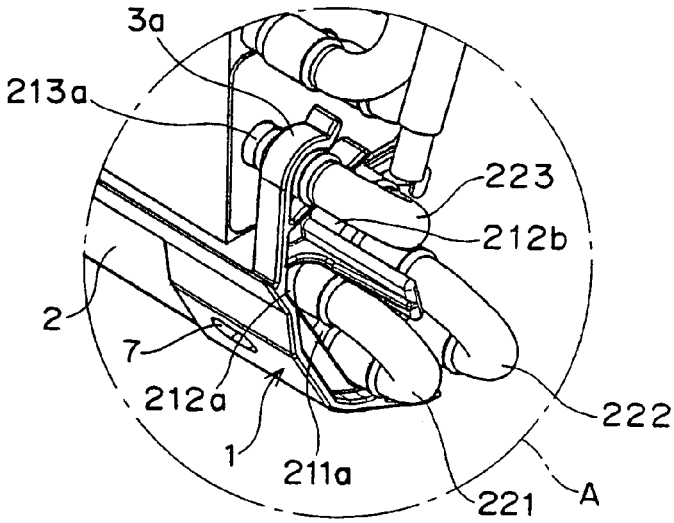

SHIELDING MEMBER AND INDOOR UNIT OF AN AIR CONDITIONER

CROSS-REFERENCE TO RELATED APPLICATIONS

This U.S. National stage application claims priority under 35 U.S.C. §119(a) to Japanese Patent Application No. 2004-319553, filed in Japan on Nov. 2, 2004, the entire contents of which are hereby incorporated herein by reference.

BACKGROUND OF THE INVENTION

The present invention relates to a shielding member used for an indoor unit of an air conditioner and an indoor unit of an air conditioner using the shielding member.

Conventionally, in a plurality of indoor units of an air conditioner, which have different cooling/heating capacities, there has been proposed to use a single casing and provide heat exchangers having different sizes (e.g., see Patent Document 1: JP 7-42010Y2). Thereby, the casing is shared among the indoor units having different cooling/heating capacities to reduce the number of components, thus reducing manufacturing cost.

However, in the conventional indoor units of the air conditioner, since it is required to manufacture heat exchangers with different sizes depending on their cooling/heating capacities, the number of components is still large and the manufacturing cost is relatively higher.

In the conventional indoor units of the air conditioner, since heat exchangers with different sizes depending on their cooling/heating capacities are used, for example, if outdoor units are exchanged for larger ones than the originals so as to increase their cooling/heating capacities, it is also required to exchange indoor units for larger ones, because it is not possible to increase their heat exchanging capacities with the original heat exchangers. That is, it is difficult to increase the cooling/heating capacities of the indoor units of the conventional air conditioner.

SUMMARY OF THE INVENTION

It is therefore an object of the present invention to provide a shielding member that can effectively reduce the number of components as well as the manufacturing cost. It is also an object of the present invention to provide an indoor unit of an air conditioner that can change its heat exchange capacity without exchanging a heat exchanger (although a flowing direction of a refrigerant may be changed).

A shielding member according to the present invention is configured so as to be placed in an indoor unit of an air conditioner, the indoor unit having a heat exchanger and a fan for bringing air to the heat exchanger, and to block air flow into a part of the heat exchanger.

With the above construction, in the indoor unit of the air conditioner, which is provided with the shielding member, passage of air through the part of the heat exchanger, that is, ventilation of the part of the heat exchanger, is prevented, so that the heat exchange capacity of the heat exchanger is reduced. Therefore, by using the shielding member depending on the cooling/heating capacity to be given to the indoor unit of the air conditioner, the heat exchanger can be made common to various indoor units having different cooling/heating capacities. As a result, the number of different components is efficiently reduced, so that cost reduction can efficiently be achieved.

In the indoor unit of the air conditioner, which is provided with the shielding member, if, for example, one attempts to increase a cooling/heating capacity by changing the outdoor unit, the heat exchange capacity can easily be increased by removing the shielding member. Since the cooling/heating capacity of the indoor unit of the air conditioner can easily be adjusted by attachment and removal of the shielding member, it is possible to use the indoor unit for a long time.

It is preferred that the shielding member be formed so as to prevent passage of air through the heat exchanger at a part where a refrigerant is not supplied. In particular, it is preferred that the heat exchanger be formed such that refrigerant flow can be switched between on and off (i.e., flowing and shutoff) in some of heat transfer tubes provided in this heat exchanger and that the shielding member be formed so as to prevent air flow into a part of the heat exchanger that corresponds to the heat transfer tubes in which flow of the refrigerant is shut off.

The shielding member usable includes, for example, a plate, a tape, and any other material as long as it prevents air flow into a part of the heat exchanger.

In one embodiment, the shielding member includes a shielding plate formed so as to cover a part of the heat exchanger, and a heat transfer tube engagement section connected with the shielding plate and formed so as to be engageable with a heat transfer tube of the heat exchanger.

According to the above embodiment, the heat transfer tube engagement section engages with the heat transfer tube of the heat exchanger, whereby the shielding member is fixed to the heat exchanger in a state in which the shielding plate covers a part of the heat exchanger. Thus, the shielding member can easily be mounted on the heat exchanger.

In one embodiment, the shielding member includes a shielding plate formed so as to cover a part of the heat exchanger, and an attachment portion provided at the shielding plate to be attached to a tube plate of the heat exchanger.

According to the above embodiment, the attachment portion is attached to the tube plate of the heat exchanger, whereby the shielding member is mounted on the heat exchanger in a state in which the shielding plate covers a part of the heat exchanger. For example, a threaded hole is provided in the tube plate of the heat exchanger, and a screw hole is provided as the attachment portion of the shielding member, and a screw passing through the screw hole is fastened into the threaded hole, whereby the shielding plate can be mounted in an appropriate position of the heat exchanger, and not mounted in an improper position where the heat exchanger requires passage of air.

In one embodiment, the shielding member includes a shielding plate formed so as to cover a part of the heat exchanger, the shielding member being attached either to a drain pan for receiving condensate from the heat exchanger or to a casing of the indoor unit of the air conditioner.

In this embodiment, by mounting the shielding member on the drain pan for receiving condensate, i.e., condensed water, from the heat exchanger or the casing of the indoor unit of the air conditioner, a part of the heat exchanger is covered with the shielding plate. In particular, the shielding member can cover a portion where the ventilation volume is reduced by the placement of the drain pan, in comparison with the other portions. That is, in the heat exchanger, portions where the reduction of the ventilation volume due to the drain pan does not occur are ventilated to perform heat exchange. Therefore, good heat exchange efficiency is obtained.

In one embodiment, the shielding member includes a fin engagement portion connected with the shielding plate and formed so as to be engageable with a fin of the heat exchanger.

In this embodiment, the fin engagement portion engages with a fin of the heat exchanger, whereby the shielding plate is fixed in proximity to the fin of the heat exchanger. Therefore, warping, vibration and the like of the shielding plate can be reduced, thus making it possible to effectively block air passage to a part of the heat exchanger.

In one embodiment, the shielding member includes a bypass preventing rib for preventing air brought by the fan from being directed to the part of the heat exchanger.

In the embodiment, the bypass preventing rib can prevent air from being directed toward the part of the heat exchanger. Therefore, it is possible to effectively prevent air from leaking to the part of the heat exchanger that does not perform heat exchange, so that reduction of the heat exchange capacity more than necessary is avoided.

In one embodiment, the shielding member includes a mismounting preventing portion for preventing the shielding member from being mounted on a heat exchanger which does not require blocking of air flow into the heat exchanger.

According to the above embodiment, the mismounting preventing portion can effectively prevent the shielding member from being erroneously mounted on a heat exchanger which does not require partial blocking of air ventilation.

An indoor unit of an air conditioner according to an embodiment includes the shielding member.

According to the above embodiment, since the heat exchanger can be shared between the indoor unit of the air conditioner and an indoor unit of another air conditioner which is not provided with the shielding member, the number of components is effectively reduced to execute cost reduction effectively.

Furthermore, by removing the shielding member, the heat exchange capacity of the heat exchanger can be increased than as originally intended. Thus, it is easy to change the cooling/heating capacity of the indoor unit of the air conditioner. This makes it possible to cope with, for example, change of an outdoor unit of the air conditioner, a change in the heat load of a room to be air conditioned and the like. As a result, the indoor unit of the air conditioner can be used for a long term.

As described above, because the shielding member according to the present invention is configured so as to be placed in an indoor unit of an air conditioner, the indoor unit having a heat exchanger and a fan for bringing air to the heat exchanger, and to block air flow into and through a part of the heat exchanger (i.e., partial ventilation of the heat exchanger), the heat exchanger can be shared among indoor units with different cooling/heating capacities by using the shielding member depending on the cooling/heating capacities to be given to the indoor units of the air conditioners. Therefore, the number of components is effectively reduced and cost reduction is thereby achieved effectively. In addition, if one wishes to increase the cooling/heating capacity of the indoor unit of the air conditioner provided with the shielding member, it is achieved by removing the shielding member, so that it is easy to increase the cooling/heating capacity of the heat exchanger. Therefore, it becomes easy to, for example, cope with replacement of an outdoor unit, which allows the indoor unit to be used for a long term.

BRIEF DESCRIPTION OF THE DRAWINGS

The present invention will become more fully understood from the detailed description given hereinbelow and the accompanying drawings which are given by way of illustration only, and thus are not intended to limit the present invention, and wherein:

FIG. 8A is a perspective view showing the right side part of the heat exchanger, as seen from its front side;

FIG. 8B is an enlarged perspective view showing portion A of FIG. 8A in which a heat transfer tube engagement section of the shielding member engages with a heat transfer tube;

DETAILED DESCRIPTION OF THE INVENTION

The present invention will hereinafter be described in detail based on the embodiments illustrated.

Figure 1:
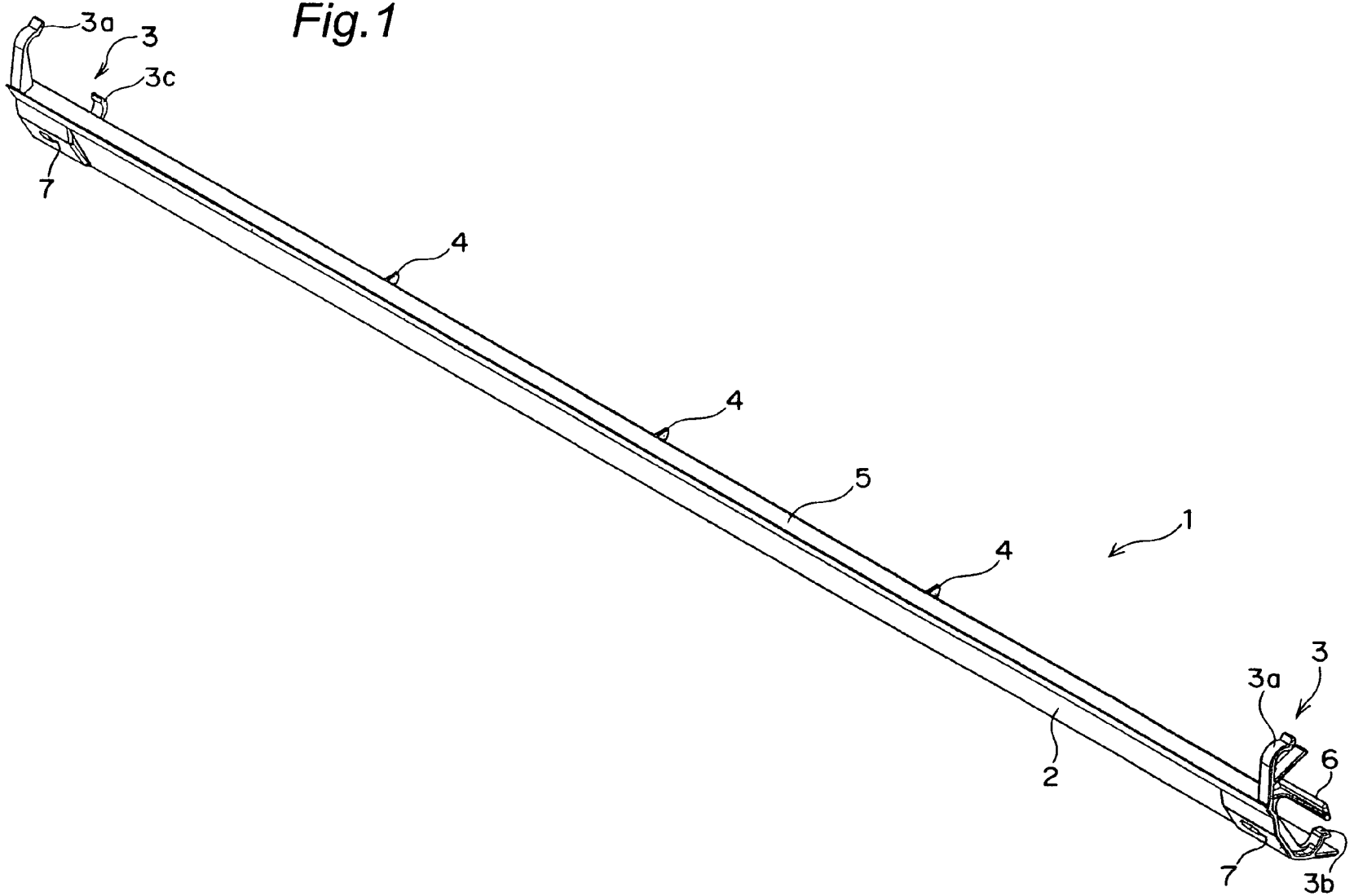
FIG. 1 is a perspective view showing a shielding member according to an embodiment of the present invention.
Figure 2:
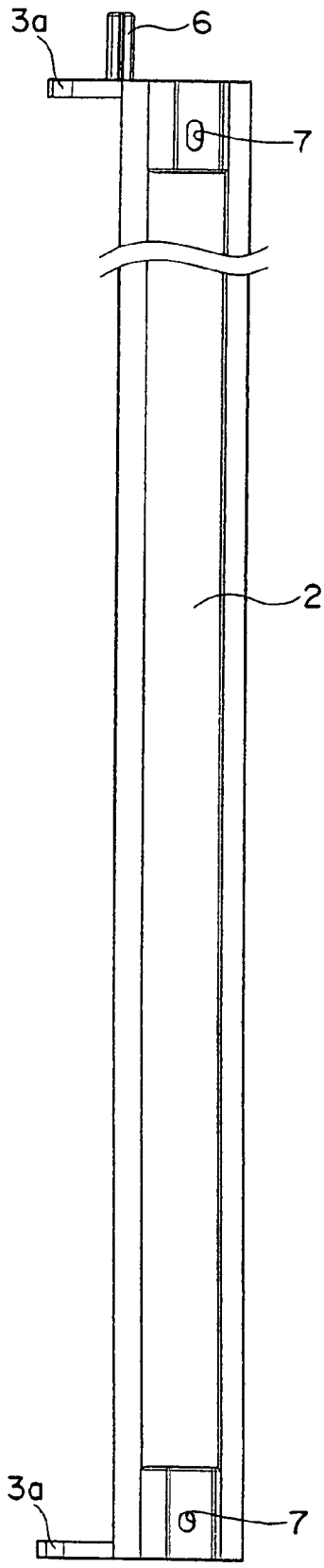
FIG. 2 is a front view of the shielding member.
Figure 3:
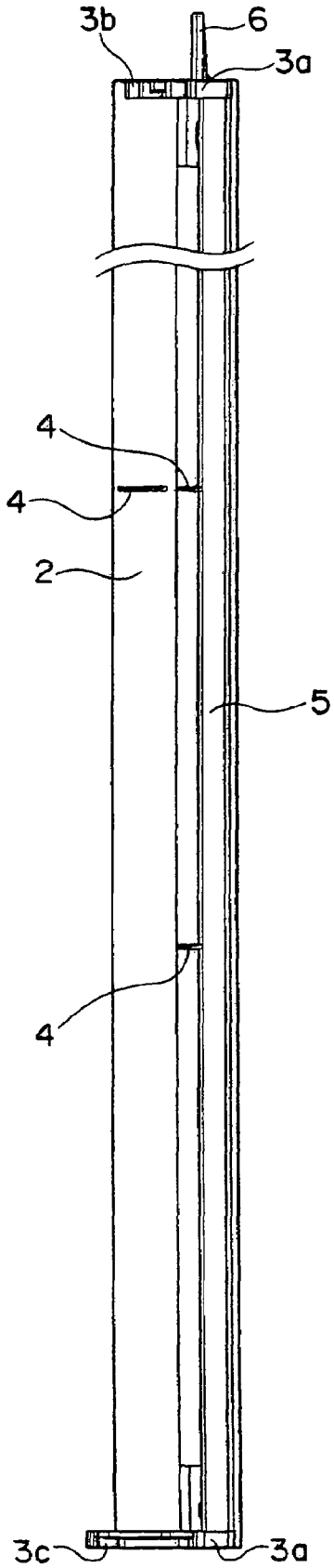
FIG. 3 is a plan view of the shielding member.
Figure 4:
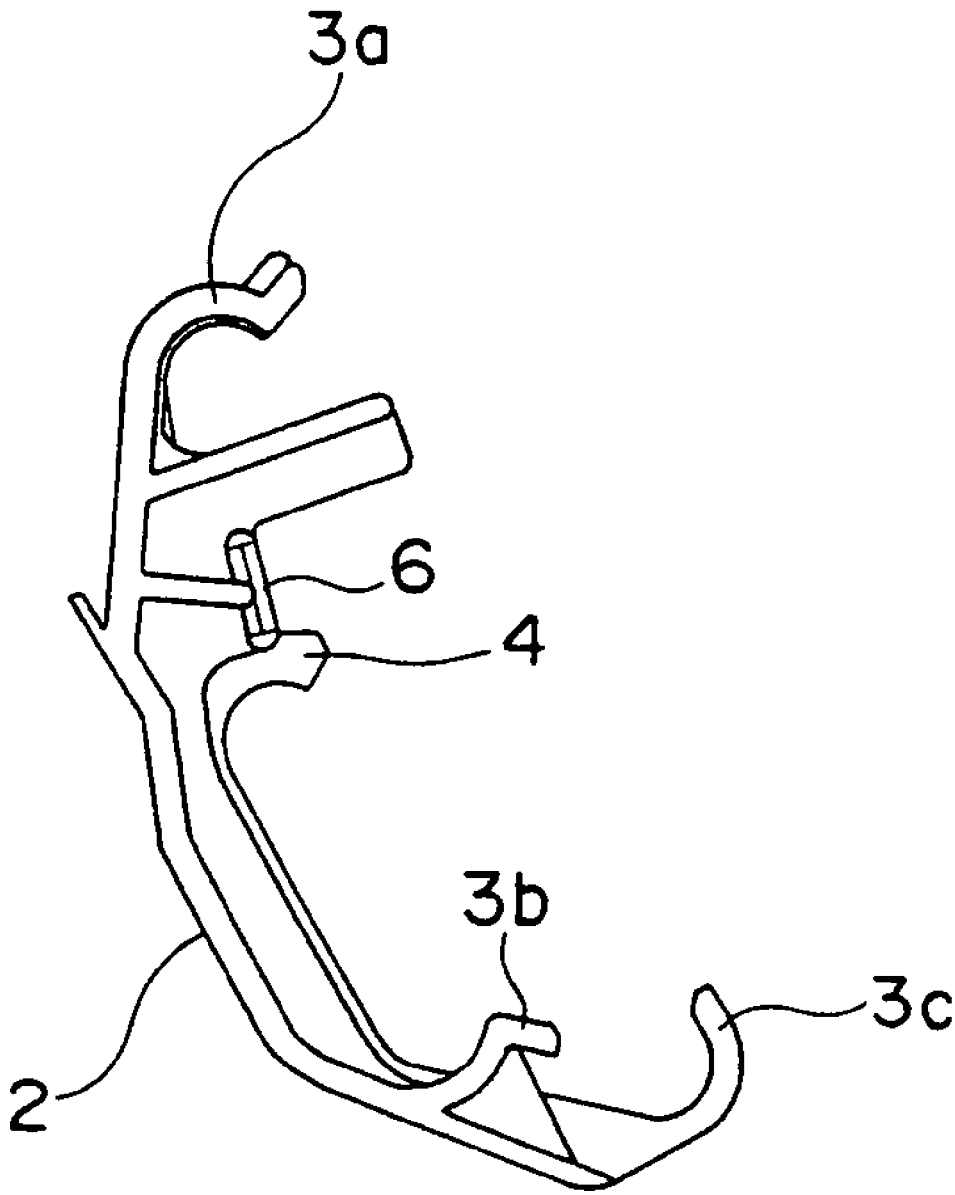
FIG. 4 is a side view of the shielding member.

FIG. 1 is a perspective view showing a shielding member 1 of an embodiment of the present invention, FIG. 2 is a front view of the shielding member 1, FIG. 3 is a plan view of the shielding member 1, and FIG. 4 is a side view of the shielding member 1.

The shielding member 1 is used for an indoor unit of an air conditioner, and is configured so as to be mounted on a heat exchanger of the indoor unit and block passage of air to a part of the heat exchanger. The shielding member 1 includes a shielding plate 2 shaped so as to cover a part of the heat exchanger on which the shielding plate is to be mounted. The shielding plate 2 is bent generally in an arc shape in cross section. Heat transfer tube engagement sections 3 for engaging a heat transfer tube of the heat exchanger are provided at both ends in the longitudinal direction of the shielding plate 2. In detail, the heat transfer tube engagement section 3 provided at a right end, seen from the front of the shielding plate 2, is constructed of a hook-shaped first engagement portion 3*a* protruding from the upper end of the shielding plate and an arc-shaped second engagement portion 3*b* protruding from the vicinity of the lower end of the shielding plate. On the other hand, a heat transfer tube engagement section 3 provided at a left end, seen from the front of the shielding plate 2, is constructed of a hook-shaped first engagement portion 3*a* protruding from the upper end of the shielding plate, an arc-shaped second engagement portion 3*b* protruding from the vicinity of the lower end of the shielding plate, and a hook-shaped third engagement portion 3*c* protruding from the lower end of the shielding plate. Furthermore, three fin-engaging portions 4 for engaging with fins 25 of the heat exchanger are disposed at regular intervals in the longitudinal direction on the inside surface of the generally arc-shaped shielding plate 2. Each fin engaging portion protrudes in a direction generally perpendicular to the longitudinal direction of the shielding plate 2, and its planar surface extend in a vertical direction of the shielding plate 2. A bypass preventing rib 5 for preventing air from being directed to the part of the heat exchanger is provided in the vicinity of the upper edge of the shielding plate 2. The bypass preventing rib 5 has a planar surface that extends in the longitudinal direction of the shielding plate 2 and protrudes generally perpendicularly to the shielding plate 2 inwardly of the shielding plate 2. The upper edge on the right side of the shielding plate 2, as seen from the front of the shielding plate 2, is provided with a bar-shaped mismounting preventing portion 6 for preventing the shielding member 1 from being mounted on a heat exchanger that does not require prevention of partial air ventilation. The mismounting preventing portion 6 extends generally parallel to the longitudinal direction of the shielding plate 2. The shielding plate 2, the heat transfer tube engagement sections 3, the fin engaging portions 4, the bypass preventing rib 5 and the mismounting preventing portion 6 are integrally molded with a resin. Although screw holes 7 are formed at both ends in the longitudinal direction of the shielding plate 2, these screw holes 7 can be dispensed with in the case where the heat transfer tube engaging portions are provided.

Figure 5:
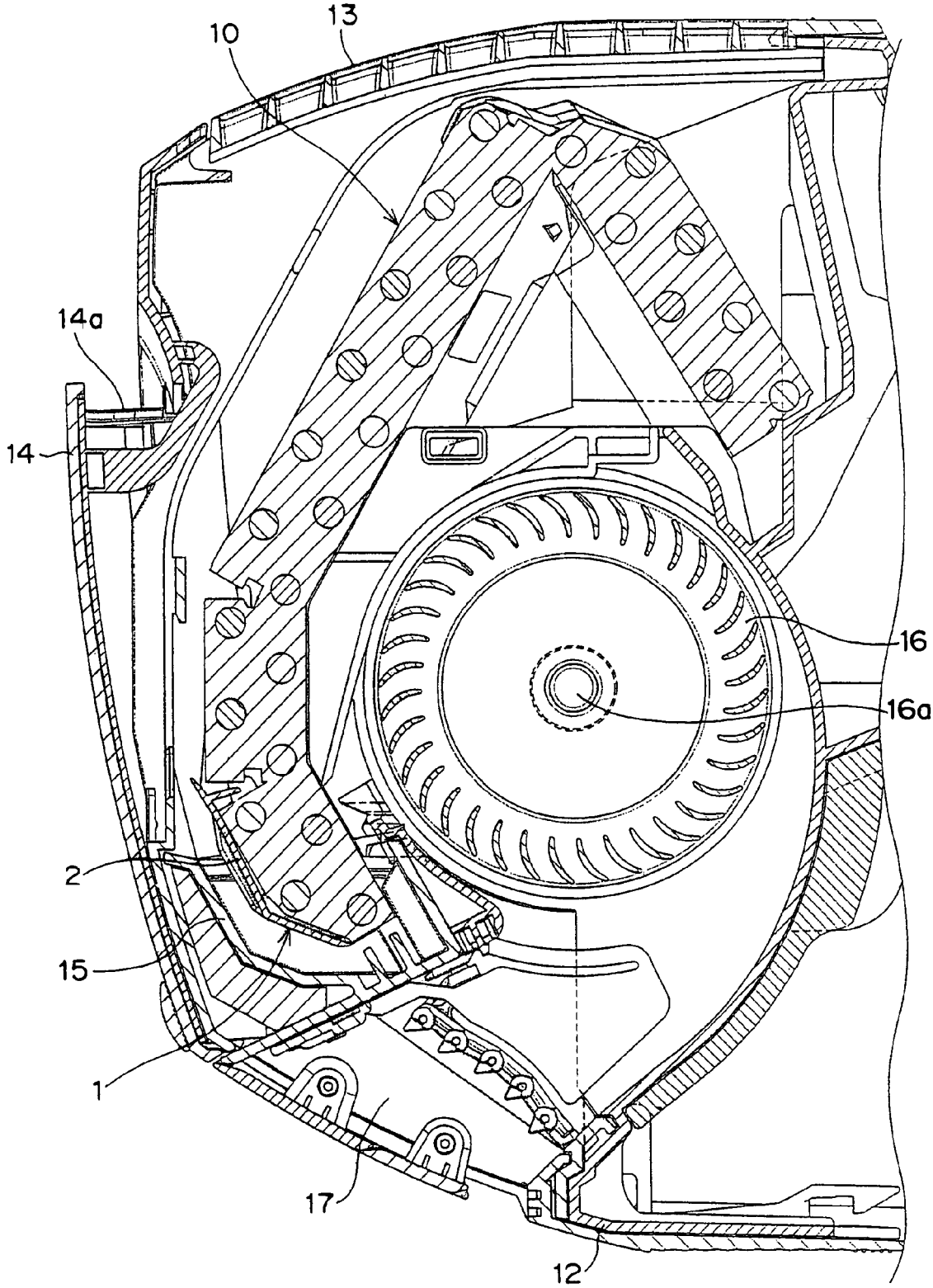
FIG. 5 is a cross sectional view showing an indoor unit of an air conditioner, in which the shielding member is installed.
Figure 6:
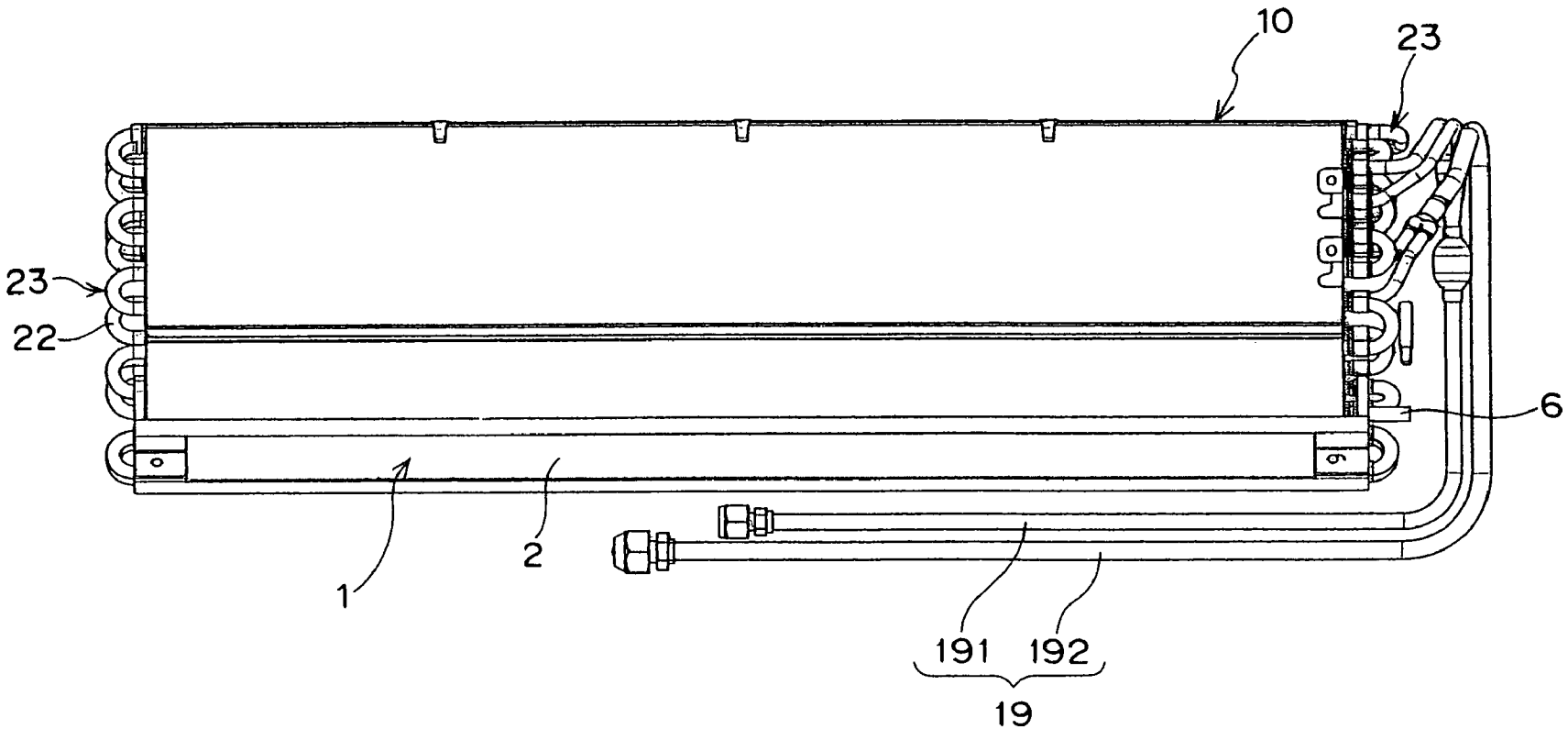
FIG. 6 is a front view of a heat exchanger and a shielding member taken out of the indoor unit.
Figure 7:
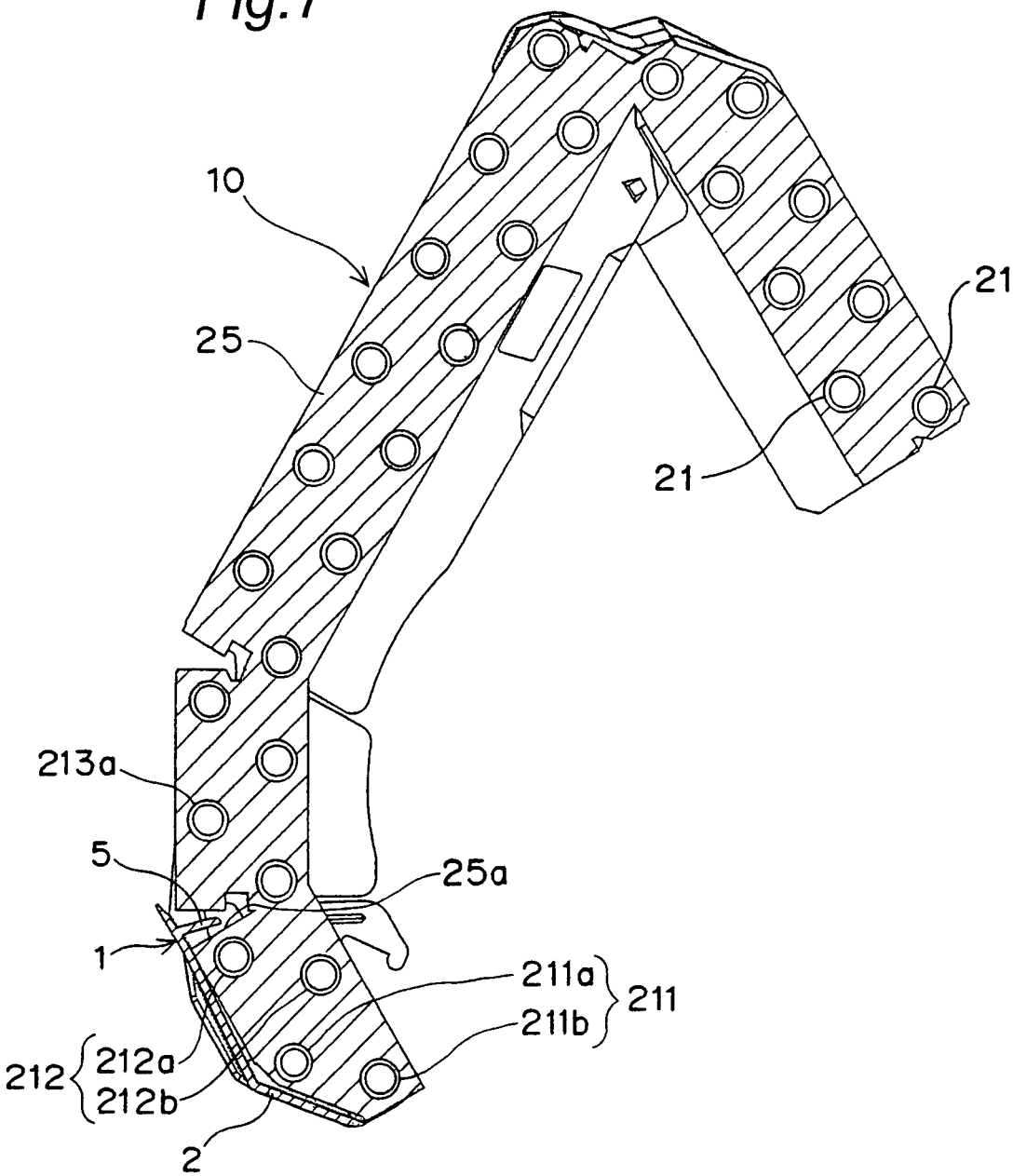
FIG. 7 is a cross sectional view of the heat exchanger and the shielding member.

FIG. 5 is a cross sectional view showing an indoor unit of an air conditioner in which the shielding member 1 is installed. FIG. 6 is a front view of a heat exchanger 10 and the shielding member 1 taken out of the indoor unit, and FIG. 7 is a cross sectional view of the heat exchanger 10 and the shielding member 1.

As shown in FIG. 5, the indoor unit of the air conditioner includes a bottom panel 12 to be fixed to a wall, a top panel 13, which is connected with an upper end of the bottom panel 12 and formed with a grill for sucking indoor air, and a front panel 14, which is connected with the top panel 13 and fitted at the front side so as to be openable and closeable. An upper part of the front panel 14 is formed with slits 14*a* for sucking indoor air. The heat exchanger 10 having a generally reverse V-shape in cross section is disposed inside of the front panel 14. A cross flow fan 16 is disposed between the heat exchanger 10 and the bottom panel 12. The cross flow fan 16 has a generally cylindrical shape and its circumferential surface is provided with a plurality of blades extending along a rotational axis 16*a*. Further, the indoor unit has an outlet 17 for blowing air heat-exchanged by the heat exchanger 10 into the room, adjacent to a lower end of the front panel 14. A drain pan 15 for receiving condensed water from the heat exchanger 10 is provided above the outlet 17 and near the lower end of the front side of the heat exchanger 10.

The shielding member 1 is mounted at an end of the outlet 17 side of the heat exchanger 10. In the front view of the heat exchanger 10 shown in FIG. 6, the side on which an end of communication piping 19 connected with the heat exchanger 10 is located corresponds to the outlet 17 side. The communication piping 19 consists of a liquid pipe 191 and a gas pipe 192, and is connected with an outdoor unit having a compressor and an outdoor heat exchanger (not shown). From the outdoor unit, a heat transfer medium at a predetermined temperature is supplied to the heat exchanger 10 via either of the liquid pipe 191 and the gas pipe 192. The heat transfer medium that has been heat-exchanged with indoor air by the heat exchanger 10 is returned to the outdoor unit via the other of the liquid pipe 191 and the gas pipe 192. The liquid pipe 191 diverges in two, i.e., first and second liquid pipes 191*a*, 191*b*, which are connected to the heat exchanger 10. The gas pipe 192 diverges in two, i.e., first and second gas pipes 192*a*, 192*b*, which are connected with the heat exchanger 10.

The heat exchanger 10 includes heat transfer tubes 23 consisting of a plurality of linear tubes 21 and a plurality of U-shaped tubes 22 for connecting the plurality of linear tubes 21, and a plurality of fins 25 which the linear tubes 21 of the heat transfer tubes 23 pass through. As shown in FIG. 7, the linear tubes 21 of the heat transfer tubes are provided in two lines, i.e., on the outer and inner surface sides of the V-shaped heat exchanger 10, and in 14 stages in the longitudinal direction of the plurality of fins 25. The plurality of fins 25 are arranged in a juxtaposed manner at predetermined intervals between tube plates 27 disposed at the right and left ends in the longitudinal direction of the heat exchanger 10. The plurality of fins 25 are arranged so that they face a direction perpendicular to the paper surface of FIG. 6. The individual fins 25 are not shown in FIG. 6.

As shown in FIGS. 6 and 7, the outlet 17-side end portion of the heat exchanger 10 is covered with the shielding plate 2 of the shielding member 1. A part of the heat exchanger 10, which is covered with the shielding plate 2, corresponds to linear tubes 211 and 212 at first and second stages from the outlet 17-side end (hereinafter referred to as "lower end"). As described below, a heat transfer medium is not supplied to the linear tubes 211 and 212 at the two stages. The bypass preventing rib 5 of the shielding member 1 protrudes toward the inner side of the heat exchanger 10 above a linear tube 212*a* out of the linear tubes 212 at the second stage, the linear tube 212*a* being positioned at the outer side of the heat exchanger. In more detail, the fins 2 are formed with a notch 25*a* above the linear tubes 212 in the second stage from the lower end, and the bypass preventing rib 5 of the shielding member 1 is inserted into the notch.

Figure 9A:
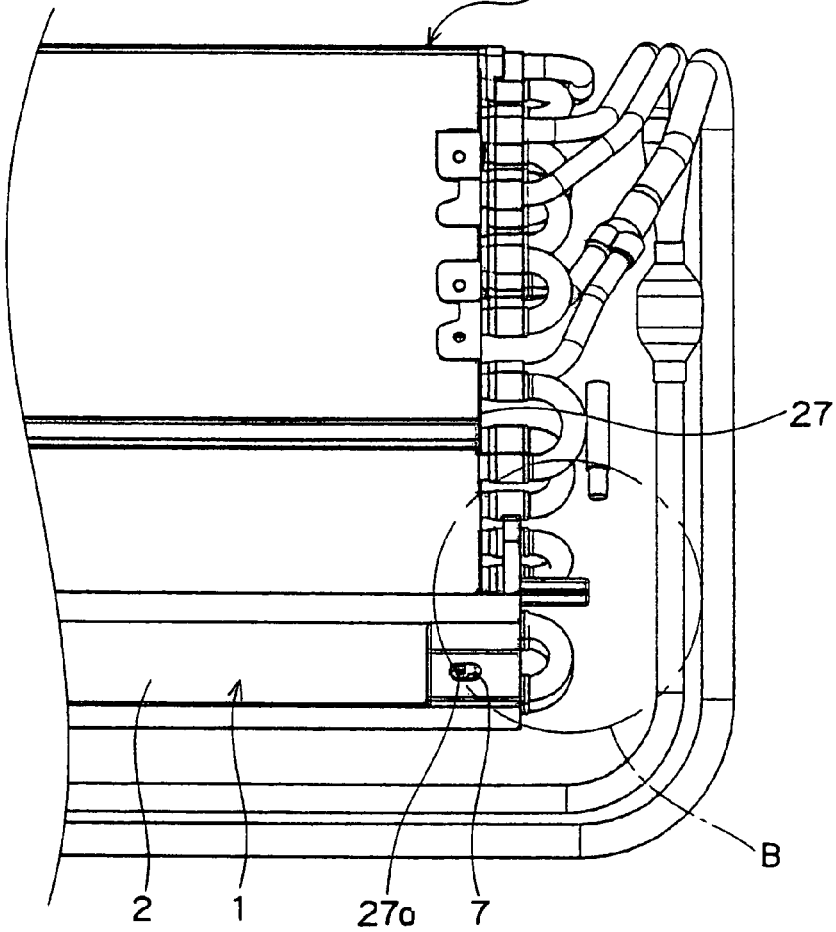
FIG. 9A is a front view of the portion shown by FIG. 8A.

FIG. 8A is a perspective view showing the right side part of the heat exchanger 10, as seen from its front, and FIG. 8B is an enlarged perspective view showing portion A in which the heat transfer tube engagement section 3 of the shielding member 1 engages with a heat transfer tube. FIG. 9A is a front view of the portion shown in FIG. 8A, and FIG. 9B is an enlarged front view showing portion B of FIG. 9A, which shows the vicinity of the mismounting preventing portion 6 of the shielding member 1.

As shown in FIGS. 8A and 8B, of the heat transfer tube engagement section 3, the first engagement portion 3*a*, which protrudes from an upper end of the shielding plate 2, engages with an end of a linear tube 213*a* which is positioned on the outer side of the heat exchanger 10 and at the third stage from its lower end. The second engagement portion 3*b*, which protrudes from the vicinity of the lower end of the shielding plate 2, engages with an end of the linear tube 211*a* which is positioned on the outer side of the heat exchanger 10 and at the first stage from its lower end. In the heat transfer tube engagement section 3 on the left-hand side as seen from the front of the heat exchanger 10, the first and second engagement portions 3*a* and 3*b* engage with the linear tubes 213*a* and 211*a*, while the third engagement portion 3*c* engages with the linear tube 211*b* which is positioned on the inner side of the heat exchanger 10 and at the first stage from its lower end.

Figure 9B:
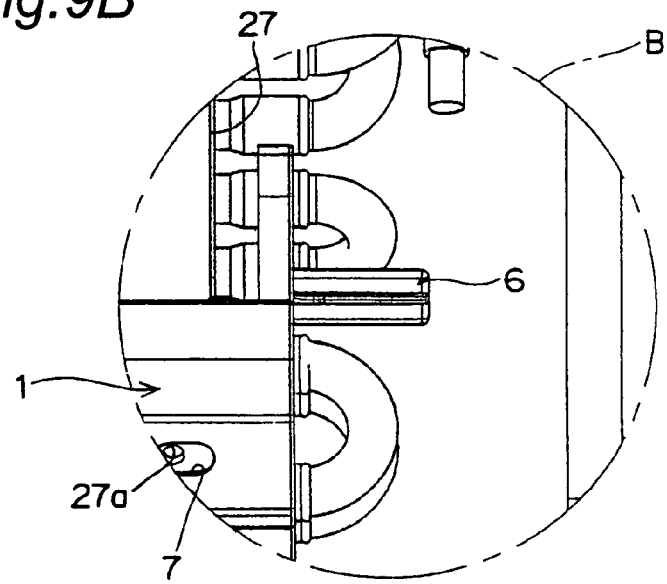
FIG. 9B is an enlarged front view showing portion B of FIG. 9A, which is a mismounting preventing portion area of the shielding member.

As shown in FIGS. 8B and 9B, the mismounting preventing portion 6 of the shielding member 1 is located between the linear tube 212*a*, which is positioned on the outer side of the heat exchanger 10 and at the second stage from its lower end, and the linear tube 213*a*, which is positioned on the outer side of the heat exchanger 10 and at the third stage. In more detail, the mismounting preventing portion 6 is disposed in a gap between a U-shaped tube 221 connected with the outer side linear tube 212*a* at the second stage and an U-shaped tube 223 connected with the outer side linear tube 213*a* at the third stage, without interfering with these U-shaped tubes 221 and 223.

Figure 10A:
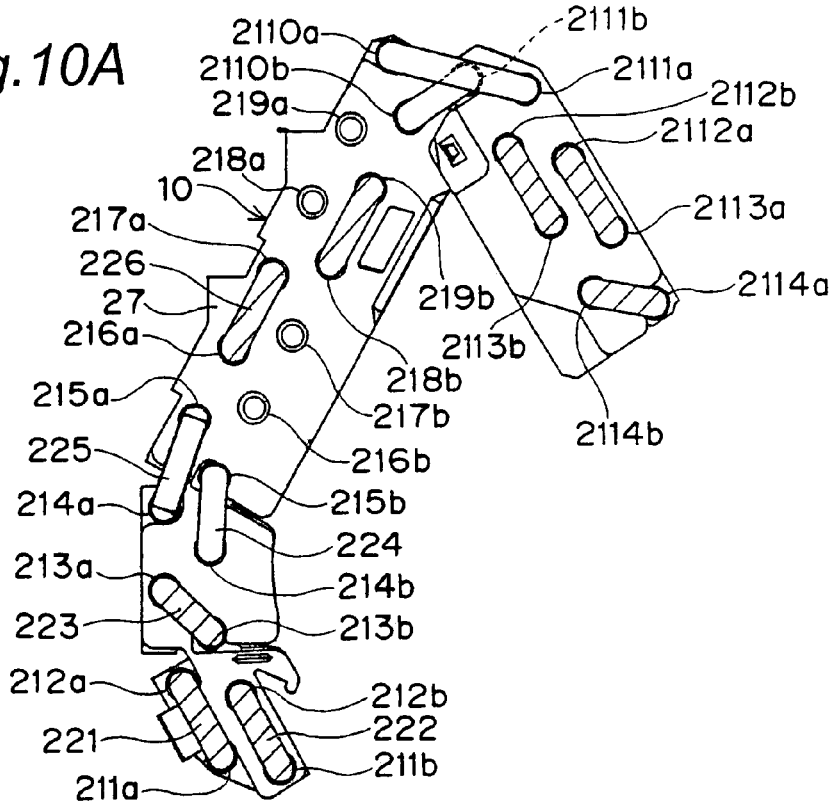
FIG. 10A is a view showing the right side of the heat exchanger.
Figure 10B:
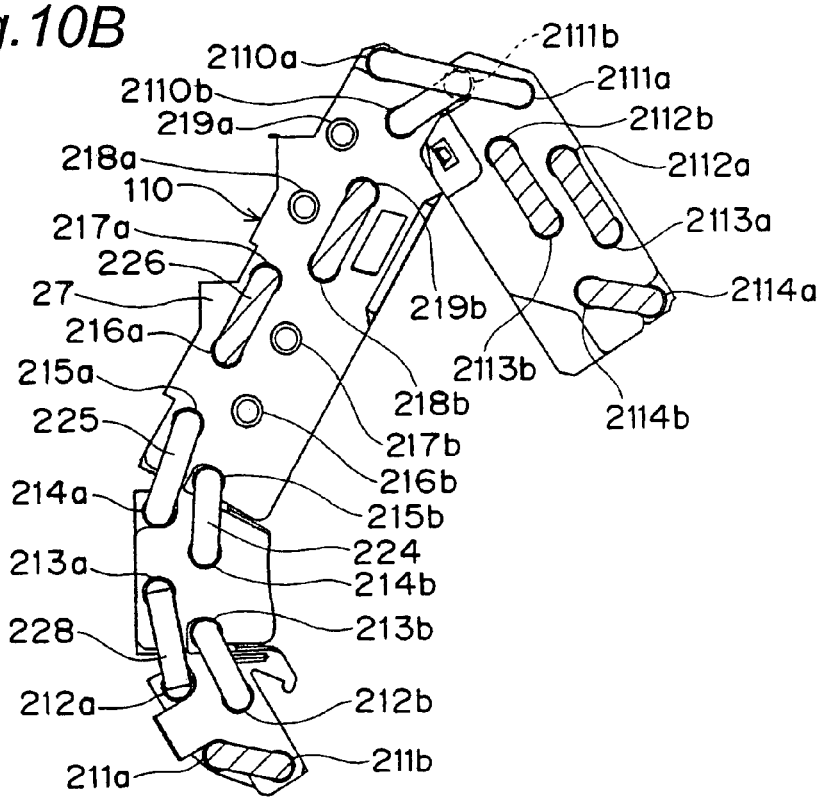
FIG. 10B is a side view showing a heat exchanger as a comparative example.

FIG. 10A is a view showing the right side face of the heat exchanger 10, in which a surface of the tube plate 27 for supporting ends of the heat transfer tubes is exposed. FIG. 10B is a side view showing a heat exchanger 110 as a comparative example. The heat exchanger 110 has the same linear tubes and fins as those of the heat exchanger 10, but has a different arrangement of U-shaped tubes, which is the only difference between the two heat exchangers. Although the heat exchanger 10 of the present embodiment has the same size as that of the heat exchanger 110 of the comparative example, the heat exchanger 10 of the present embodiment has a smaller heat exchange capacity than the heat exchanger 110 of the comparative example due to the U-shaped tube arrangement. Specifically, as shown in FIG. 10A, in the heat exchanger 10 of the present embodiment, linear tubes 213*a* and 213*b* at the third stage from the lower end of the outer and inner sides are connected with each other with a U-shaped tube 223, whereby a heat transfer medium is not supplied to the linear tubes 211 and 212 at the first and second stages from the lower end.

In more detail, an outer side eighth stage linear tube 218*a*, which is connected with the first liquid pipe 191*a* of the communication piping, is connected with an outer side linear tube 217*a* at the seventh stage through a U-shaped tube on the side of the heat exchanger 10 longitudinally opposite to the side shown in FIG. 10A. The outer side linear tube 217*a* at the seventh stage is connected with an outer side linear tube 216*a* at the sixth stage through a U-shaped tube 226 as shown in FIG. 10A. The outer side linear tube 216*a* at the sixth stage is sequentially connected with outer side linear tubes 215*a*, 214*a* and 213*a* at the fifth, fourth and third stages through a plurality of U-shaped tubes 225 located on either side of the longitudinal direction of the heat exchanger 10. The outer side linear tube 213*a* at the third stage is connected with the inner side linear tube 213*b* at the third stage through a U-shaped tube 223. The inner side linear tube 213*b* at the third stage is sequentially connected with inner side linear tubes 214*b*, 215*b* and 216*b* at the fourth, fifth and sixth stages through a plurality of U-shaped tubes 224 located on either side of the longitudinal direction of the heat exchanger 10. The inner side linear tube 216*b* at the sixth stage is connected with the first gas pipe 192*a* of the communication piping. That is, the outer side linear tubes 218*a*, 217*a*, 216*a*, 215*a*, 214*a*, 213*a* at the eighth, seventh, sixth, fifth, fourth and third stages and the inner side linear tubes 213*b*, 214*b*, 215*b* and 216*b* at the third, fourth, fifth and sixth-stages are sequentially connected between the first liquid pipe 191*a* and the first gas pipe 192*a* of the communication piping.

On the other hand, the outer side linear tubes 211*a*, 212*a* at the first and second stages and the inner side linear tubes 211*b*, 212*b* at the first and second stages are connected so as to form a closed loop with the U-shaped tubes 221 and 222 on the left and right sides of the heat exchanger 10. a portion corresponding to the linear tubes 211*a*, 212*a*, 211*b*, 211*b* at the two stages, which form the closed loop and are not connected with the communication piping, is covered with the shielding plate 2 of the shielding member.

Outer side linear tubes 219*a*, 2110*a*, 2111*a*, 2112*a*, 2113*a*, and 2114*a* at the ninth, tenth, eleventh, twelfth, thirteenth and fourteenth stages and inner side linear tubes 2114*b*, 2113*b*, 2112*b*, 2111*b*, 2110*b*, 219*b*, 218*b* and 217*b* at the fourteenth, thirteenth, twelfth, eleventh, tenth, ninth, eighth and seventh stages of the inner surface side are sequentially connected between the second liquid pipe 191*b* and the second gas pipe 192*b* of the communication piping.

On the other hand, in the heat exchanger 110 of the comparative example shown in FIG. 10B, the number of the linear tubes that are connected between the first liquid pipe 191*a* and the first gas pipe 192*a* of the communication piping is different from that of the heat exchanger of the present embodiment shown in FIG. 10A. Specifically, the outer side linear tubes 218*a*, 217*a*, 216*a*, 215*a*, 214*a*, 213*a*, 212*a*, and 211*a* at the eighth, seventh, sixth, fifth, fourth, third, second and first-stages and the inner side linear tubes 211*b*, 212*b*, 213*b*, 214*b*, 215*b* and 216*b* at the first, second, third, fourth, fifth and sixth stages are sequentially connected between the first liquid pipe 191*a* and the first gas pipe 192*a* of the communication piping. The number of linear tubes connected between the second liquid pipe 191*b* and the second gas pipe 192*b* of the communication piping is the same as that of the present embodiment of FIG. 10A.

The indoor unit of the air conditioner of the present embodiment operates as follows. The cross flow fan 16 is driven to rotate around the rotational axis 16*a* by a fan motor not shown, so that an airflow is generated in a direction crossing the rotational axis 16*a*. Thereby, indoor air is sucked through the grill of the top panel 13 and the slits of the front panel 14 and led to the heat exchanger 10. The sucked air is heat-exchanged with the heat transfer medium flowing inside the heat transfer tubes and then discharged from the outlet 17.

In the heat exchanger 10, the portion corresponding to the linear tubes 211 and 212 at the lowest two stages is covered with the shielding plate 2 of the shielding member, while the bypass preventing rib 5 of the shielding member protrudes above the linear tube 212*a*. Thereby, air flow into the portion corresponding to the linear tubes 211 and 212 at the two stages where no heat transfer medium is supplied can effectively be blocked. Therefore, air is effectively supplied to and passed through those portions of the heat exchanger 10 that correspond to the linear tubes at the third to fourteenth stages and that have a heat exchange function. As a result, the heat exchange capacity of the heat exchanger 10 can effectively be obtained.

Use of the shielding member 1 to block air flow to the first and second stages of the heat exchanger 10 and the adjustment of the arrangement of the U-shaped tubes allows the heat exchanger components to be shared between the air conditioner indoor unit of the present embodiment and the air conditioner indoor unit using the heat exchanger 110 of the comparative example. Therefore, the heat exchanger of the embodiment can be shared between the indoor units having different cooling/heating capacities, so that the number of components is effectively reduced to thereby achieve cost reduction.

By removing the shielding member 1 and adjusting the arrangement of the U-shaped tubes, the heat exchanger 10 included in the air conditioner indoor unit of the present invention can easily obtain the same heat exchange capacity as that of the heat exchanger 110 of the comparative example. Therefore, it is possible to easily increase the cooling/heating capacity of the indoor unit following, for example, the replacement of the outdoor unit. As a result, the air conditioner indoor unit of the present embodiment can be used for a long term.

Due to the engagement of the heat transfer tube engagement sections 3 with the linear tubes 211*a*, 211*b* and 213*a* of the heat transfer tubes, the shielding member 1 can easily be attached to and detached from the heat exchanger 10. This makes it easy to manufacture the indoor unit of the air conditioner and also perform operations such as for the change of the cooling/heating capacity of the indoor unit.

By the bypass preventing rib 5, the shielding member 1 can effectively prevent air from flowing to the portion corresponding to the heat transfer tubes 211, 212 at the first and second stages from the lower end of the heat exchanger 10. Therefore, reduction of the heat transfer efficiency can effectively be prevented.

By the fin engagement portions 4, the shielding plate 2 of the shielding member 1 is retained with its longitudinally central area close to the edges of the fins 25. Thus, warping of the shielding plate 2 can be suppressed. Therefore, air leakage to the portion corresponding to the heat transfer tubes 211 and 212 at the first and second stages of the heat exchanger can effectively be prevented, so that reduction of the heat exchange efficiency can effectively be prevented.

By the mismounting preventing portion 6, the shielding member 1 is prevented from being mounted on the heat exchanger 110 of the comparative example which does not require the shielding member 1. More specifically, if one attempts to mount the shielding member 1 on the heat exchanger 110 of the comparative example in which a refrigerant flows through the whole linear tubes of the heat transfer tubes, the mismounting preventing portion 6 is brought into contact with the U-shaped tube 228 connecting the outer side linear tube 212*a* at the second stage and the outer side linear tube 213*a* at the third stage. Therefore, the shielding member 1 can surely be prevented from being erroneously mounted on the heat exchanger 110 of the comparative example.

In the above embodiment, the shielding member 1 has a shielding plate 2 and the screw holes 7 formed, as attachment portions, at both ends of the shielding plate 2, in which case the heat transfer tube engagement sections 3 may be omitted. In this case, at an edge of the tube plate 27, which is provided on both sides of the heat exchanger 10, a tongue-shaped small plate that is bent in a direction generally perpendicular to an extending surface of the tube plate 27 is provided, and a threaded hole 27*a* is formed in the small plate (see FIGS. 9A and 9B). A screw which has passed through the screw hole 7 of the shielding member 1 is fixed in this threaded hole 27*a* of the tube plate. Thereby, the shielding member 1 is attached to the heat exchanger 10 with a simple structure. By providing in advance the threaded hole 27*a* in an appropriate position of the tube plate 27, the shielding member 1 can be mounted at an appropriate position of the heat exchanger 10 without being erroneously mounted in assembling the air conditioner.

Figure 11A:
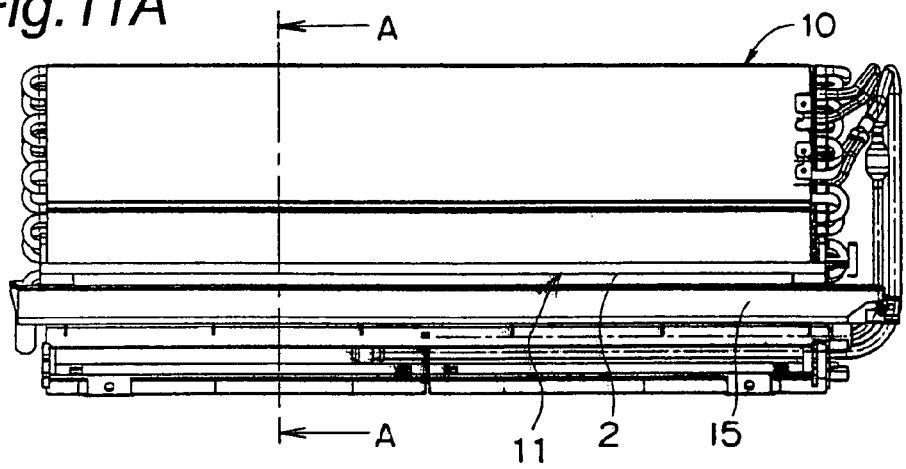
FIG. 11A is a view showing a shielding member 11 according to another embodiment of the present invention.
Figure 11B:
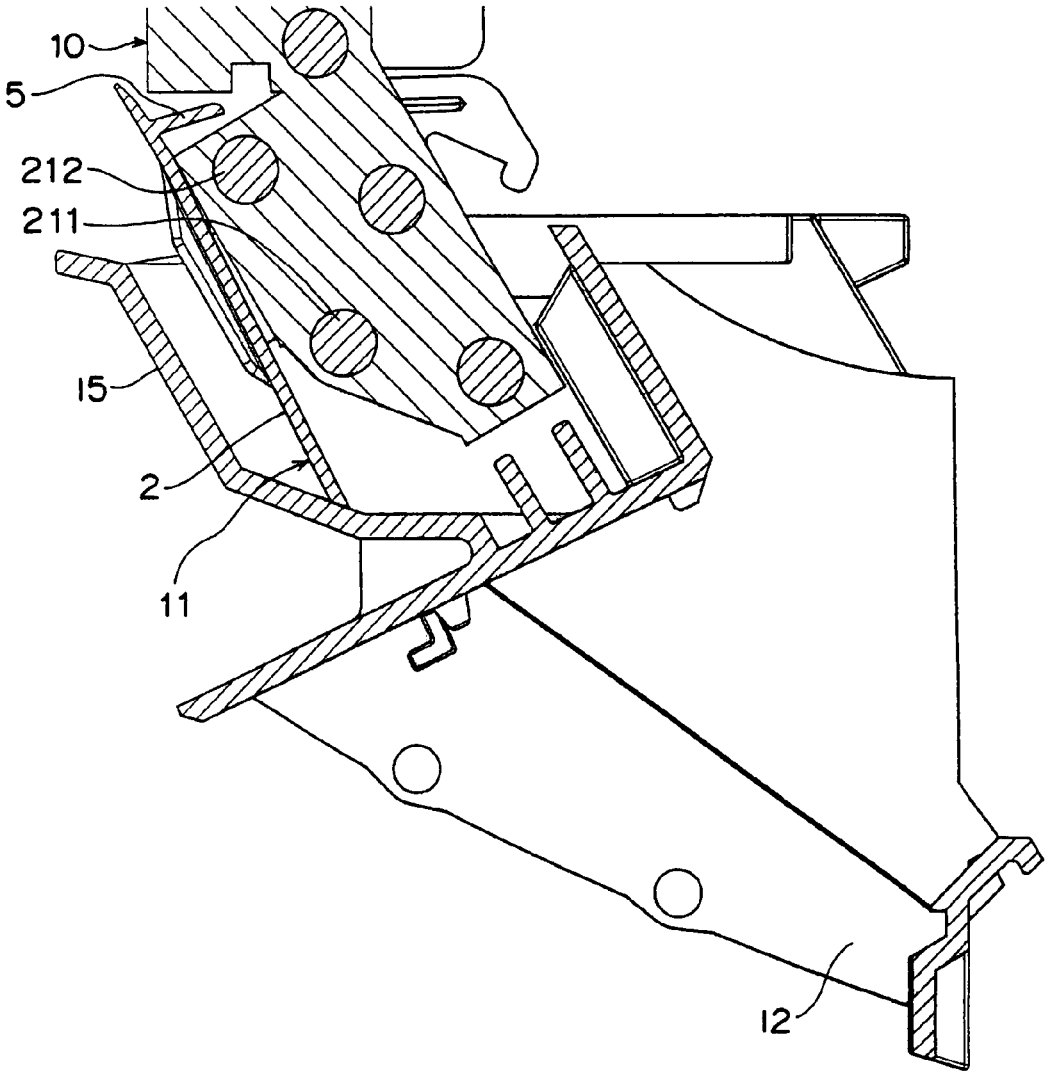
FIG. 11B is a cross sectional view taken along line A-A of FIG. 11A.

FIG. 11A is a view showing a shielding member 11 according to another embodiment of the present invention, and FIG. 11B is a cross sectional view taken along line A-A of FIG. 11A.

The shielding member 11 of the present embodiment is fixed to a drain pan 15, more specifically, the shielding member 11 and the drain pan 15 are integrally formed. The shielding member 11 has an elongate rectangular-shaped shielding plate 2 that extends along the width of the heat exchanger 10, and the lower end of the shielding plate 2 is fixed to the bottom of the inside of the drain pan 15. A rib 5 that extends generally perpendicular to the shielding plate 2 is fixed in the vicinity of an upper edge of the shielding plate 2. The shielding plate 2 covers a portion in front of the two-stage linear tubes 211 and 212 positioned in a lower end portion of the front side of the heat exchanger 10. On the other hand, the drain pan 15, which extends along the width of the heat exchanger 10 as well as has a recess-shaped cross section, surrounds the lower end portion of the front side of the heat exchanger 10. A drain hose for discharging condensed water received from the heat exchanger 10 is connected to one longitudinal end of the drain pan 15. The integrally formed shielding member 11 and drain pan 15 are connected with the bottom panel 12 through connection portions provided at both ends of the drain pan 15.

The lower end portion of the heat exchanger 10 is surrounded by the drain pan 15, whereby the amount of air flow of the lower end portion becomes smaller than those of the other portions. Since the lower end portion of the heat exchanger 10 having a smaller amount of air flow is surrounded by the shielding member 11 integrally formed with the drain pan 15, air passes through other portions of the heat exchanger 10 where there is no reduction of air flow due to the drain pan 15. In this manner, air is made to flow through those portions where air is easy to flow, so that air flow efficiency of the cross flow fan 16 can be improved, and the heat exchange efficiency of the heat exchanger 10 can be improved. The shielding member 11 is not necessarily integrally formed with the drain pan 15. The shielding member 11 and the drain pan 15 that are separately formed may be connected with each other. The shielding plate 2 may be provided with fin engagement portions 4 for engaging with the fins 25 of the heat exchanger. The shielding member 11 may also be mounted on the bottom panel 12 forming a casing of the indoor unit, instead of being mounted to the drain pan 15. In this case, both of the ends in the longitudinal direction of the shielding member 11 are mounted on the inside of the lateral sides of the bottom panel 12.

In the above embodiments, although the shielding member 1, 11 is made using the shielding plate 2, it may also be made using a tape and any other material as long as it has a function of blocking air flow into a part of the heat exchanger 10.

The heat exchanger 10 is not limited to one having a reverse V-shape, and heat exchangers of any shape may be used.

Portions at which air flow is to be blocked by the shielding member 1, 11 are not limited those corresponding to the linear tubes at the first and second stages from the lower end of the heat exchanger 10, and they may appropriately be changed as required.

A plurality of shielding members may be provided for one heat exchanger.

The present invention is not limited to the application to a wall hung type indoor unit, and may be applied to any type of indoor unit such as a built-in type, a floor type, etc.

Embodiments of the invention, being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A shielding member configured so as to be installed in an indoor unit of an air conditioner, the indoor unit having a heat exchanger, a fan for bringing air to the heat exchanger, an outlet and heat transfer tubes including a heat transfer tube to which refrigerant flow is switchable between flowing and shut off, the shielding member being formed such that when installed in the indoor unit, the shielding member blocks air flow into a part of the heat exchanger corresponding to the heat transfer tube to which the refrigerant flow is switchable between flowing and shut off.

2. The shielding member as claimed in claim 1, further comprising a shielding plate formed so as to cover a part of the heat exchanger; and an attachment portion provided at the shielding plate to be attached to a tube plate of the heat exchanger.

3. The shielding member as claimed in claim 1, further comprising a shielding plate formed so as to cover a part of the heat exchanger, the shielding member being attached either to a drain pan for receiving condensation from the heat exchanger or to a casing of the indoor unit of the air conditioner.

4. A shielding member configured so as to be placed in an indoor unit of an air conditioner, the indoor unit having a heat exchanger and a fan for bringing air to the heat exchanger and to block air flow into a part of the heat exchanger, the shielding member comprising:

a shielding plate formed so as to cover a part of the heat exchanger;

a heat transfer tube engagement section connected with the shielding plate and formed so as to be engageable with a heat transfer tube of the heat exchanger; and a fin engagement portion connected with the shielding plate and formed so as to be engageable with a fin of the heat exchanger.

5. A shielding member configured so as to be placed in an indoor unit of an air conditioner, the indoor unit having a heat exchanger and a fan for bringing air to the heat exchanger and to block air flow into a part of the heat exchanger, the shielding member comprising:

a bypass preventing rib for preventing air brought by the fan from being directed to said part of the heat exchanger.

6. A shielding member configured so as to be placed in an indoor unit of an air conditioner, the indoor unit having a heat exchanger and a fan for bringing air to the heat exchanger and to block air flow into a part of the heat exchanger, the shielding member comprising:

a mismounting preventing portion for preventing the shielding member from being mounted on a heat exchanger which does not require blocking of air flow into the heat exchanger.

7. An indoor unit of an air conditioner, comprising the shielding member as claimed in claim 1.

8. A shielding member configured so as to be placed in an indoor unit of an air conditioner, the indoor unit having a heat exchanger and a fan for bringing air to the heat exchanger and to block air flow into a part of the heat exchanger, the shielding member comprising:

a shielding plate formed so as to cover a part of the heat exchanger;

an attachment portion provided at the shielding plate to be attached to a tube plate of the heat exchanger; and a fin engagement portion connected with the shielding plate and formed so as to be engageable with a fin of the heat exchanger.

9. A shielding member configured so as to be placed in an indoor unit of an air conditioner, the indoor unit having a heat exchanger and a fan for bringing air to the heat exchanger and to block air flow into a part of the heat exchanger, the shielding member comprising:

a shielding plate formed so as to cover a part of the heat exchanger, the shielding member being attached either to a drain pan for receiving condensation from the heat exchanger or to a casing of the indoor unit of the air conditioner; and a fin engagement portion connected with the shielding plate and formed so as to be engageable with a fin of the heat exchanger.

10. The shielding member as claimed in claim 1, further comprising a shielding plate formed so as to cover an outlet side end portion of the heat exchanger when the shielding member is installed in the indoor unit.

11. The shielding member as claimed in claim 1, the shielding member is disposed to extend substantially parallel to outer surfaces of the heat exchanger portion which it covers when installed in the indoor unit.

12. The shielding member as claimed in claim 1, the shielding member is non-movably attached to the heat exchanger when installed in the indoor unit.

* * * * *